US006261180B1

(12) United States Patent
Lebensfeld et al.

(10) Patent No.: US 6,261,180 B1
(45) Date of Patent: Jul. 17, 2001

(54) COMPUTER PROGRAMMABLE INTERACTIVE TOY FOR A SHOOTING GAME

(75) Inventors: Steven Lebensfeld, Laurel Hollow, NY (US); David Chu Ki Kwan, Tsuen Wan (HK); Frank Landi, Great Neck, NY (US); Sammy To; Deni Rivette, both of Hong Kong (HK)

(73) Assignee: Toymax Inc., Plainview, NY (US)

( * ) Notice: Subject to any disclaimer, the term of this patent is extended or adjusted under 35 U.S.C. 154(b) by 0 days.

(21) Appl. No.: 09/019,747

(22) Filed: Feb. 6, 1998

(51) Int. Cl.[7] ..... A63B 67/00; A63F 9/02
(52) U.S. Cl. ..... 463/49; 463/51
(58) Field of Search ..... 463/1, 2, 5, 30–31, 463/50–56, 36, 39; 446/175, 397, 401, 404, 405, 406, 436, 437, 441, 442, 443, 465, 473; 434/20–22, 24, 307 R; 340/323 R; 900/91–92

(56) References Cited

U.S. PATENT DOCUMENTS 2,119,005 5/1938 Carter .
2,404,653 7/1946 Plebanek .
2,957,693 * 10/1960 Ross .

(List continued on next page.)

OTHER PUBLICATIONS

Sega "Lock On" toy description in IDS dated Jun. 29, 1998 and photocopies of product carton and instructions.
Worlds of Wonder Laser Tag description in IDS dated Jun. 29, 1998 and product photograph.
Panosh Laser Combat Description in IDS Dated Jun. 29, 1998 and product photograph.
LJN/Entertech Photon Description in specification and photocopies of product carton.
Golub Laser Pro 9000 description in IDS dated Jun. 29, 1998 and photocopies of product carton.
Hasbro Survivor Shot description in specification and product photograph.
Instructions for Tiger Electronics Lazer Tag toy.

*Primary Examiner*—Mark Sager
(74) *Attorney, Agent, or Firm*—Brown Raysman Millstein Felder & Steiner LLP

(57) ABSTRACT

The invention disclosed herein relates to a portable, programmable, interactive toy for a shooting game played by radiating and appropriately detecting infrared light (or other radiated energy). A player set includes an IR light projector (gun), an IR light detector (target) and a detachable, programmable data (or program) module which controls operation of the toy in accordance with data programmed therein. The data module may be detached, and the toy will operate in a default mode which is downwardly compatible with other toys that do not include the programmable data module. The toy also includes a base unit which programs the data modules to provide each player with a unique firing code. The data modules may also include circuitry which recognizes the different codes. The data modules may accumulate game and player information such as the number of shots fired by the associated gun, the number of hits registered by the associated target, and the source (player identification) of each hit registered. The base unit is a computer which programs the data module, uploads and downloads information, and processes information uploaded from the data module and provides the results of processing thereon, including computation results. The detachable data module provides for modularity by which game functions and features implemented by modules may be added to and removed from a particular toy.

29 Claims, 7 Drawing Sheets

U.S. PATENT DOCUMENTS

| | | | | |
|---|---|---|---|---|
| 3,202,425 | | 8/1965 | Van Hennik . | |
| 3,294,401 | * | 12/1966 | Nicholas et al. . | |
| 3,499,650 | | 3/1970 | Lemelson . | |
| 3,508,751 | | 4/1970 | Meyer et al. . | |
| 3,549,147 | | 12/1970 | Katter et al. . | |
| 3,795,400 | | 3/1974 | Glass et al. . | |
| 3,847,396 | * | 11/1974 | Ashford . | |
| 3,870,305 | | 3/1975 | Harclerode . | |
| 3,960,380 | | 6/1976 | Yokoi . | |
| 3,964,178 | * | 6/1976 | Marshall . | |
| 3,995,376 | | 12/1976 | Kimble et al. . | |
| 4,164,081 | | 8/1979 | Berke . | |
| 4,171,811 | * | 10/1979 | Meyer et al. . | |
| 4,266,776 | | 5/1981 | Goldfarb . | |
| 4,267,606 | | 5/1981 | Stelter et al. . | |
| 4,375,106 | | 2/1983 | Voll . | |
| 4,426,662 | | 1/1984 | Skerlos et al. . | |
| 4,487,583 | * | 12/1984 | Brucker . | |
| 4,545,583 | * | 10/1985 | Pearman et al. . | |
| 4,586,715 | | 5/1986 | Scolari et al. . | |
| 4,629,427 | | 12/1986 | Gallagher . | |
| 4,695,058 | * | 9/1987 | Carter, III et al. . | |
| 4,718,593 | | 1/1988 | Rötzer . | |
| 4,754,133 | | 6/1988 | Bleich . | |
| 4,772,028 | * | 9/1988 | Rockhold et al. . | |
| 4,802,675 | | 2/1989 | Wong et al. . | |
| 4,844,475 | | 7/1989 | Saffer et al. . | |
| 4,898,391 | | 2/1990 | Kelly et al. . | |
| 4,931,028 | | 6/1990 | Jaeger et al. . | |
| 4,938,483 | | 7/1990 | Yavetz . | |
| 5,029,872 | | 7/1991 | Sassak . | |
| 5,127,658 | | 7/1992 | Openiano . | |
| 5,253,068 | | 10/1993 | Crook et al. . | |
| 5,320,362 | * | 6/1994 | Bear et al. . | |
| 5,375,847 | | 12/1994 | Fromm et al. . | |
| 5,401,025 | | 3/1995 | Smith, III et al. . | |
| 5,437,463 | | 8/1995 | Fromm . | |
| 5,552,917 | | 9/1996 | Darbee et al. . | |
| 5,577,962 | | 11/1996 | Kounoe et al. . | |
| 5,613,913 | | 3/1997 | Ikematsu et al. . | |
| 5,656,907 | | 8/1997 | Chainani et al. . | |
| 5,672,108 | | 9/1997 | Lam et al. . | |
| 5,741,185 | | 4/1998 | Kwan et al. . | |
| 5,785,592 | * | 7/1998 | Jacobson | 463/53 |
| 5,904,621 | * | 5/1999 | Small | 463/53 |

* cited by examiner

COMPUTER PROGRAMMABLE INTERACTIVE TOY FOR A SHOOTING GAME

RELATED APPLICATIONS

The following U.S. patent applications, the disclosures of which are incorporated herein by reference, disclose subject matter related to the subject matter disclosed herein: application Ser. No. 08/795,895, filed Feb. 5, 1997, titled "Interactive Light-Operated Toy Shooting Game" now U.S. Pat. No. 5,741,185; and application Ser. No. 09/015,863, filed Jan. 29, 1998, titled "Player Programmable, Interactive Toy for a Shooting Game".

BACKGROUND OF THE INVENTION

The invention disclosed herein relates to a portable, interactive toy for a shooting game which is player programmed using a computer. The game is played by radiating energy, e.g., light, and detecting appropriately directed radiated energy. Any of a number of features and functions may be enabled, disabled, set, etc. and otherwise controlled via programming by the computer, and data may be uploaded to and downloaded from portable player equipment via the computer. Player equipment may be detachably coupled to the computer or coupled to the computer via a wireless link.

Toys used in shooting games played by shooting some form of light and detecting when the shot light strikes a target typically include a light emitter and a light detector. The light detector may be located with the target and detect light impinging on the target, or the light detector may be provided with the light emitter to detect light projected from a target. The target may be passive and simply reflect light impinging thereon, or active and incorporate a light emitter. Many remote control applications, including remote control of consumer electronics devices and toys, use transmitted and detected light. Some of the above toys and remote control devices pulse, modulate and/or code the light, which may be infrared ("IR") light.

The "Photon" toy of Entertech includes a gun having an IR emitter, a vest having a speaker and hit indicators, and a helmet having an IR detector and electronic sound transmitters, all tethered together. This toy also has a computerized target with an adjustable skill level.

The "Survivor Shot" toy of Hasbro includes a gun with an IR emitter and a head unit with an IR detector and a vibrator which vibrates when the head unit registers a hit. The gun and head unit are tethered. The gun is adjustable to project light for long range, short range, single shot and multiple shot.

A toy manufactured in China by Sega Enterprises Ltd. and distributed in the United Kingdom by Ban Dai (UK) Ltd. under the mark "Lock-On" includes a gun which emits IR light and a headset including an IR detector, a display and a sound generating device. The toy has a selectable lock-on feature which causes the headset of Player A to display an "H" and to beep when the gun of player "B" is appropriately pointed at player A's headset. Pressing the trigger of player B's gun during lock-on causes a hit to be registered on player A's headset. The "Lock-On" toy is capable of operation in a single player or training mode, and a player or competition or team mode. The "Lock-On" toy includes a high power feature where each detected shot is counted as three points instead of one point.

The "Laser Challenge" toy of Toymax Inc. of Plainview, New York has been on sale in the United States more than one year before the filing of this application. Application Ser. No. 08/795,895 generally describes the "Laser Challenge" toy.

The "Laser Challenge Pro" toy of Toymax Inc., generally described in application Ser. No. 09/015,863, is a portable, player programmable, interactive toy for a shooting game. The Laser Challenge Pro toy provides player sets which each include a toy gun and front and back targets, all tethered together. The gun has an IR emitter and an IR detector, and the front and back targets are mounted to a vest which includes a speaker, lamps, a vibrator and electronics. A keypad is provided on the gun for the entry of coded information to select from preprogrammed features and functions, including game modes, both prior to the start of a game and during a game. Players may interact with each in addition to detection of a hits by transferring information, which, for example, can remotely activate features and functions in another player's equipment or transfer a feature or function from one player to another.

The following U.S. patents disclose light toys or remote control devices: U.S. Pat. Nos. 2,119,005, 2,404,653, 2,957,693, 3,202,425, 3,499,650, 3,508,751, 3,549,147, 3,870,305, 3,960,380, 3,995,376, 4,164,081, 4,171,811, 4,266,776, 4,267,606, 4,375,106, 4,426,662, 4,533,144, 4,586,715, 4,629,427, 4,718,593, 4,754,133, 4,802,675, 4,844,475, 4,898,391, 4,931,028, 5,029,872, 5,253,068, 5,375,847, 5,401,025, 5,437,463, 5,552,917, 5,656,907, 5,672,108 and 5,577,962.

There is a need for a portable toy for use in a shooting game which provides for more interactivity, both between and among players and between a player and his equipment, and which controls and tracks game parameters not controlled or tracked in prior portable shooting game toys.

OBJECTS AND SUMMARY OF THE INVENTION

It is an object of the invention disclosed herein to increase the play value of toys used in shooting games by making them more interactive, and/or by controlling and/or tracking game parameters that were not controlled or tracked in prior portable shooting game toys, and/or by providing portable shooting game toys with more player selectable features, and/or by making them player programmable, and/or by linking them to cooperate, for example to transfer information which affects game play between or among players.

It is another object of the invention to modularize a portable toy for a shooting game so that features and functions implemented by modular components may be added to and removed from the portable toy.

It is another object of the invention to provide novel features for portable toys used in shooting games, particularly features that can be programmed or selected by a player at the tart of a game.

It is another object of the invention to provide portable toys for a shooting game in which the players may interact in ways in addition to shooting at an opposing player and registering and processing hits.

It is another object of the invention to provide toys for a portable shooting game in which interactivity between players is increased by the ability of one player to interact with another player other than by firing and registering hits.

It is another object of the invention to enable players in a portable shooting game to transfer information between a player's equipment and a base unit which controls, tracks, tallies, etc. game features, functions and/or parameters.

A portable toy for a shooting game which incorporates the invention includes a plurality of radiation emitters each of which may be incorporated into some type of toy gun, at least one radiation detector which may be incorporated into a toy gun or target, or into another toy item carried by a player, or even into a self-propelled or stationary toy item, an electric circuit or circuits communicating with the radiation emitters and the at least one radiation detector, and at least one base unit which communicates with the electrical circuit(s).

The base unit sets up a game by conditioning player equipment for a selected game, and then receives data accumulated by player equipment, processes the data and makes it available for display and printing. The base unit is not used during game play, except in some embodiments to further condition player equipment (e.g., reload) during a game. In the preferred embodiment the base unit includes a programmed computer which programs circuitry in player equipment to establish and control certain features and functions, and to collect game data. The base unit uploads the collected data and processes it as indicated above.

Also, the invention comprises various combinations of one or more radiation emitters, one or more radiation detectors, one or more electric circuits and one or more base units. Further, the invention provides for modularity by which game functions and features implemented by modules may be added to and removed from a particular toy.

Preferred embodiments of toys incorporating the invention provide audio and/or visual effects, including sound effects and speech phrases, associated with one or more game functions and features.

Player sets may be provided which include at least one light emitter, at least one light detector and at least one audio and/or visual device, which may comprise a single item of player toy equipment, or two or more items coupled together. These items may be coupled by a wired or wireless link. Similarly, the base unit may be coupled to an item of the player set by a wired or wireless link, and the modules mentioned above may be coupled by a wired or wireless link. "Wired link" is used herein in a broad sense and encompasses a link or coupling achieved through a tether (e.g., a cable which conducts electricity, light, sound, etc.) or a direct connection using connectors or the like. Similarly, "wireless link" is used herein in a broad sense and encompasses a link or coupling that does not require a tether or direct connection, and includes links achieved through electromagnetic, optical (including IR), electrostatic, and acoustical (including ultrasonic) coupling.

A detector typically includes some type of sensor which senses wave energy and assists in detection thereof, although the terms detector and sensor are frequently used interchangeably. Typically a detector includes some type of circuitry which receives the output of a sensor. The term "computer" is used herein in a broad sense and encompasses circuitry which operates according to a sequence of steps defined by a software program. Microcontrollers and the like which are currently widely available are encompassed by the term "computer".

A programmable device, referred to herein as a data or program module, controls operation of the player set. The programmable device may be detached from the player set, and the toy will operate in a default mode which is downwardly compatible with other toys that do not include the programmable data module. The toy also includes a programming device (the base unit).g., which is essentially a computer, that programs the programmable devices to provide each player with a unique firing code. The programmable devices may also include circuitry which recognizes the different codes. The programmable devices may accumulate game and player information such as the number of shots fired by the associated gun, the number of hits registered by the associated target, and the source (player identification) of each hit registered. The base unit programs the programmable devices, uploads and downloads information, and processes information uploaded from the programmable devices, and provides the results of processing the uploaded information, including computation results. By making the programmable device detachable, modularity is provided by which game functions and features implemented by modules may be added to and removed from a particular toy.

A toy for a shooting game according to the invention may comprise a wave energy projector comprising a wave energy source which projects wave energy from the projector, at least one circuit coupled to the energy source which controls operation of the energy source and causes the energy source to project wave energy coded according to any one of a plurality of codes and a a player programmable device (e.g., the data module described herein) coupled to the at least one circuit to provide coded information thereto. The at least one circuit is responsive to coded information provided by the programmable device to cause the energy source to project energy with a code of the plurality of codes corresponding to the coded information.

In the preferred embodiment, the programmable device comprises a memory device storing a computer program and data, and circuitry which executes the program stored in the memory device, and the programmable device provides the coded information to the at least one circuit in response to the computer program. The programming device is used to program the programmable device. The programmable device and the programming device may be linked in any suitable manner, wired or wireless. Similarly, the programmable device may be coupled to the circuit in any suitable manner, wired or wireless.

The programming device comprises an input device coupled thereto having at least one manually actuated control (e.g., a keypad) by which information can be input to the programming device. The programming device is responsive to the input information and supplies selected information to the programmable device in dependence upon the input information. A display is preferably coupled to the programming device, which displays information thereon in accordance with the computer program. The programming device relates information input by the input device with information displayed by the display, e.g., similar to mouse click operation in a personal computer, and the display may be scrolled, etc.

The programmable device also preferably process information accumulated in the programmed device. Such information may be displayed on the display, and a printer may be coupled to the programming device to print selected information.

The toy may be operable in a plurality of game modes, operating in a first game mode in the absence of coded information from the programmable device and in a second game mode in response to coded information from the programmable device. The programmable device and the at least one circuit are preferably detachably coupled, and toy operates in the first game mode when the programmable device is not coupled to the at least one circuit, and in the second game mode when the programmable device is coupled to the at least one circuit.

In order to allow the toy to be used with other toys, the toy may include a compatible circuit which permits operation with the other toys and another circuit which replaces at least part of the compatible circuit. A switch may effect the replacement, for example, when the programmable device is coupled to the at least one circuit.

BRIEF DESCRIPTION OF THE DRAWINGS

The invention is illustrated in the figures of the accompanying drawings which are meant to be exemplary and not limiting, in which like numerals in the different figures refer to like or corresponding parts, and in which.

DESCRIPTION OF THE PREFERRED EMBODIMENTS

Figure 1:
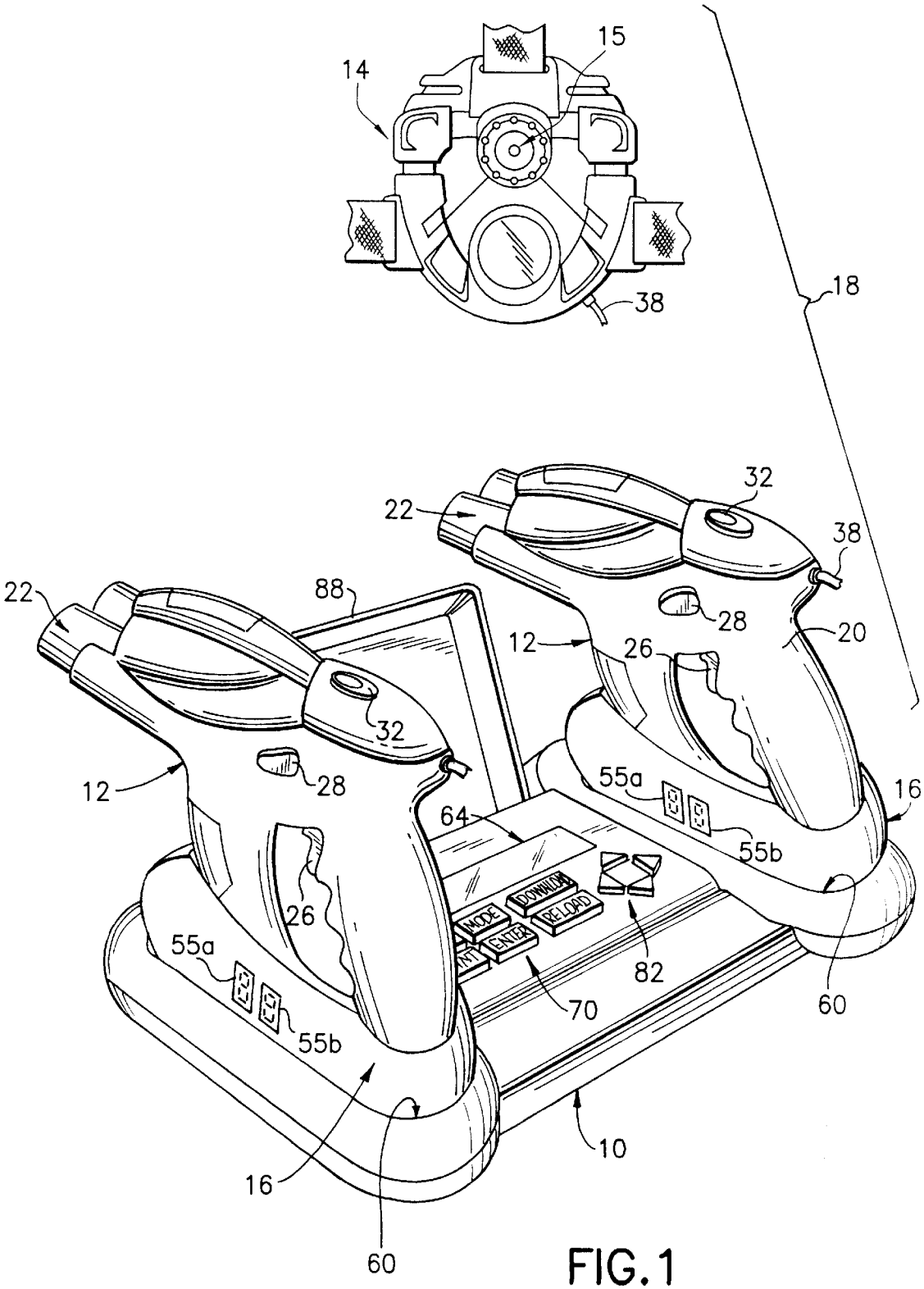
FIG. 1 is a perspective view of a base unit and two toy player sets coupled thereto, each including a toy light projector (or gun), a target, and a data or program module which is seated in the base unit, which incorporate the invention.

A shooting game is played in accordance with a preferred embodiment of the invention with a base unit 10 (FIG. 1) (sometimes referred to as a computer or a programming device), three or more radiation emitters or guns 12 configured as futuristic ray guns, and at least one target 14 which incorporates at least one radiation sensor 15. A data or program module 16 (FIG. 1) (sometimes referred to as a programmable device) is also employed, which in the preferred embodiment is provided as a detachable item that detachably attaches to the gun 12. However, the data module may be permanently incorporated in the gun 12 or a player carried target 14. The radiation employed in the preferred embodiment of the invention is IR light. Accordingly, radiation projectors and radiation sensors will be referred to below as light projectors or emitters and light sensors.

The gun 12 without the data module 16 may be used in shooting games together with other guns 12 and targets 14. When not using the data module 16, guns 12 are compatible with other Laser Challenge items available from Toymax Inc. For example, they may be used with guns and targets of the original Laser Challenge toy (see application Ser. No. 08/795,895) and the Laser Challenge Pro toy (see application Ser. No. 09/015,863. In the preferred embodiment, the compatible circuitry in the gun 12 is replaced by circuitry in the data module 16 when the data module is attached to the gun.

In the preferred embodiment, a gun 12 is used without a data module 16 simply by detaching the data module from the gun, which then uses the compatible circuitry therein. In alternative embodiments the data module is not detachable but permanently incorporated into a gun 12 (or a target 14), and a switch or other device is provided to physically, or electrically via circuitry and/or software disconnect the data module. Where compatibility with other toys is not a concern, the data module can be incorporated into the player set 18 and compatible circuitry need not be provided.

In the preferred embodiment, player sets 18 (FIG. 1) of a gun 12, at least one target 14 and a data module 16 are provided. A base unit 10 constructed in accordance with a preferred embodiment may service up to eight player sets. In a preferred embodiment, a player set 18 includes two light sensors, one incorporated in a target configured to be worn on a player's chest and another incorporated into a target configured to be worn on a player's back. FIG. 1 illustrates only one target 14. Another target may be tethered to target 14 or elsewhere in the player set 18. Such targets may be incorporated into a harness as in the Laser Challenge Pro toy, or include straps by which each may be individually worn by a player, as in the Laser Challenge toy. While the preferred embodiment includes one player-carried light sensor 15, one, two or more than three player-carried sensors may be provided, and sensors and detectors may be provided that are not carried by a player.

Figure 2:
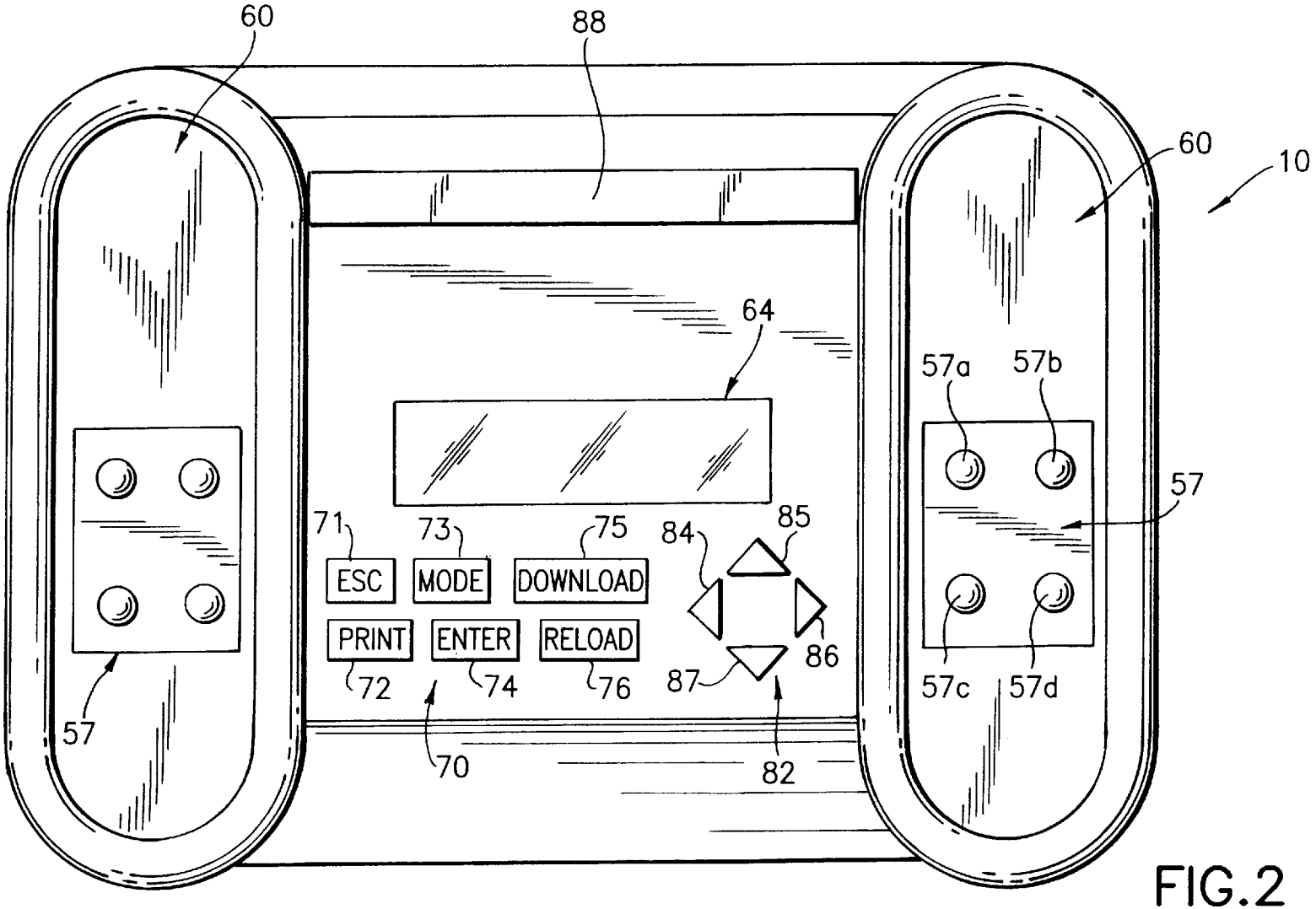
FIG. 2 is a top plan view of the base unit depicted in FIG. 1 without the player sets.
Figure 3:
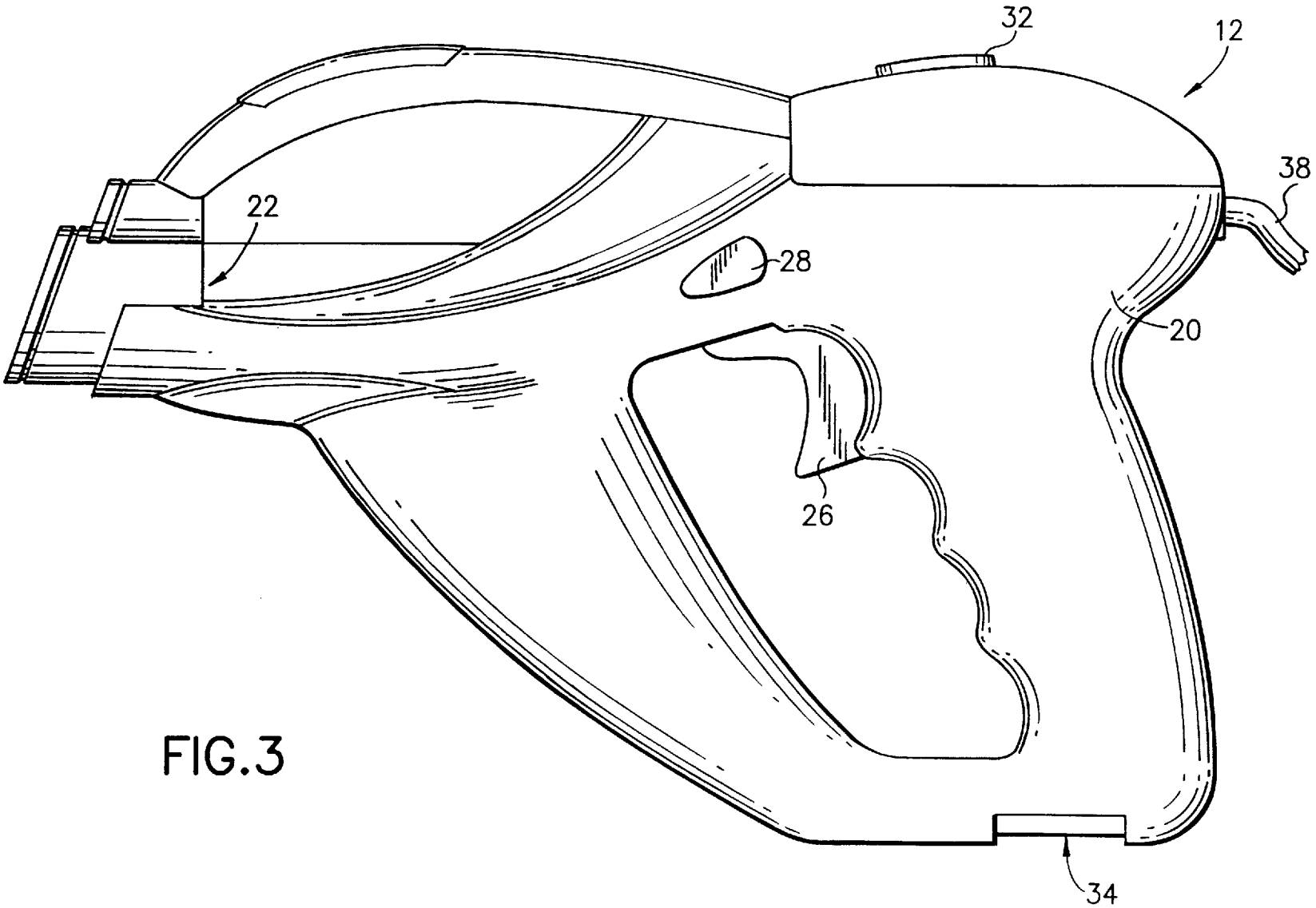
FIG. 3 is a side elevation view of one of the guns depicted in FIG. 1 without the data module attached thereto.
Figure 7:
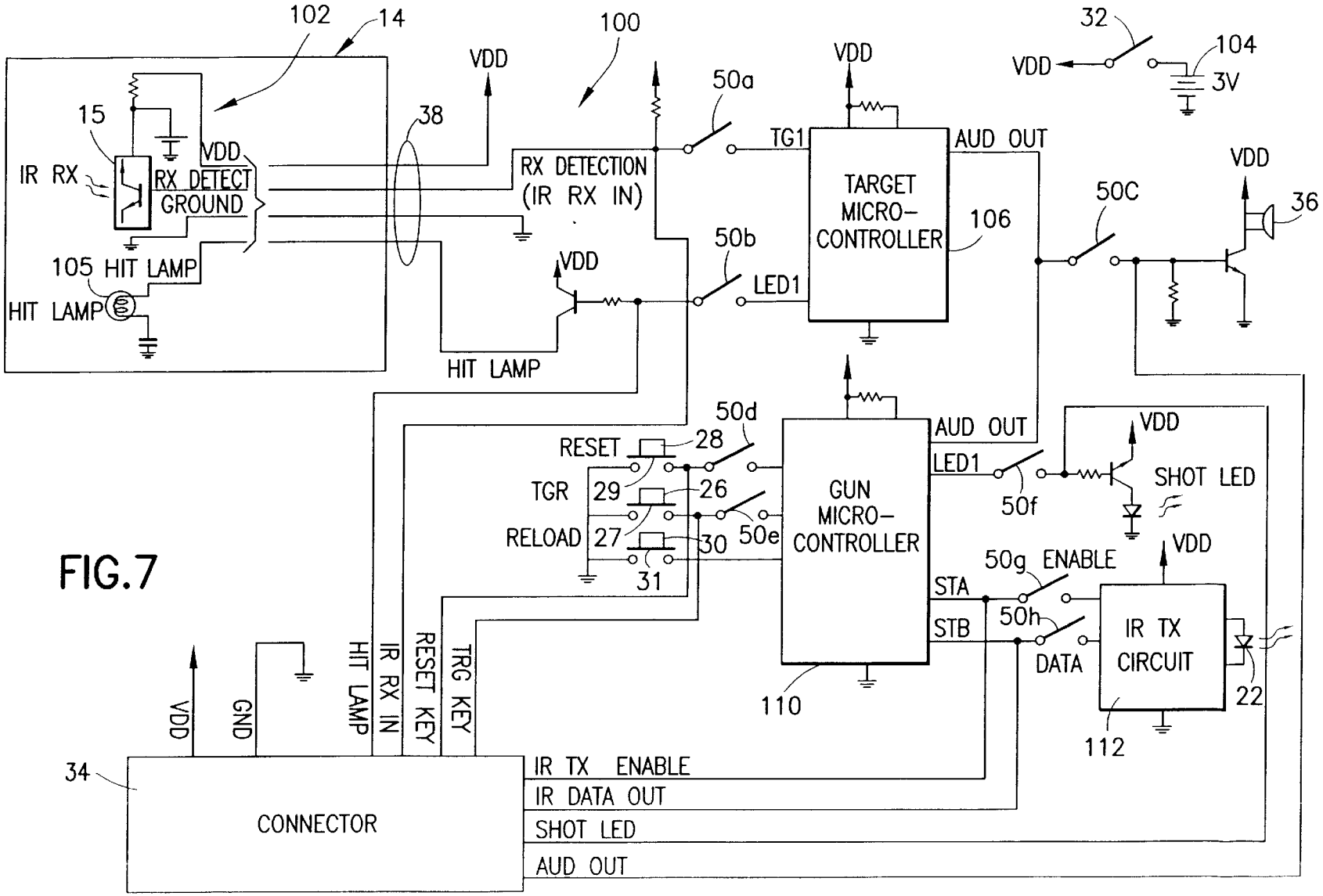
FIG. 7 is a schematic diagram of the circuitry in the gun depicted in FIG. 1 and a player carried target.

Referring to FIGS. 3 and 7, the toy light gun 12 includes a housing 20, a light emitter 22 (FIG. 7), at least one light emitting diode (LED) 24 (FIG. 7), a trigger 26, a reset button 28, a reload button 30 (not shown in FIG. 2, but similar to button 28) on the opposite side of gun 12 from button 28, an on/off switch 32 and a connector 34 all carried by and visible from the exterior of the gun housing 20. Mounted within the gun housing 20 are a speaker 36, micro-switches 27, 29 and 31 (FIG. 7) respectively activated by the trigger 26, reset button 28 and reload button 30 and one or more PC boards (not shown) to which electrical components are mounted and for making electrical connections between components carried by the gun housing 20 and components carried by the target 14. A set of conductors 38 interconnects components carried by the gun housing 20 and the target 14.

The gun housing 20 also carries an optical system (not shown) which projects a beam of light emitted by the light emitter 22 from the toy gun 12 that can be detected by a light sensor 15 in another player's target 14. Suitable optical systems are disclosed in application Ser. Nos. 08/795,895 and 09/015,863. Shooting games may be played with the guns 12 under varying light conditions and over varying distances, depending upon the optical system used.

In the preferred embodiment, IR light emitter 22 emits amplitude modulated IR light in short bursts or pulses, and the sensor(s) of another player receive such modulated IR light and provide it to circuitry described below.

Many modulation schemes are known in the art, and the specific type used is not critical. Any known or new suitable modulation scheme may be used. However, the selected scheme must be able to encode a number of different codes, as described below. In the preferred embodiment, circuitry described below encodes light bursts by amplitude modulating them (e.g., by chopping) at a preselected frequency, and by providing different length bursts for firing from different guns, and for transmitting information from one player to another. It is practical to operate with up to about 28 different length bursts, which would allow 2 different firing source identifications, and/or features and functions to be transmitted or remotely controlled. In the preferred embodiment, the preselected frequency is 37.9 KHz., and two different length bursts may be 1.0 ms and 1.5 ms, for example. Other suitable modulation frequencies and burst lengths may be used. Also, other modulation schemes would allow for more than 28 different codes so that even more players, features and functions can be accommodated. For example, pulse width modulation may be used.

The trigger 80 is spring loaded as described in application Ser. No. 08/795,895, and fires a single shot (pulse) of light with each trigger squeeze. Because the light emitter 70 in the toy light gun 12 is an LED, which, unlike some prior art "flash" light emitters does not require high energy to "fire", the light emitter 70 will rapidly fire in response to rapid trigger squeezes, or in rapid succession in one of the rapid fire modes described in application Ser. No. 09/015,863.

Figure 4:
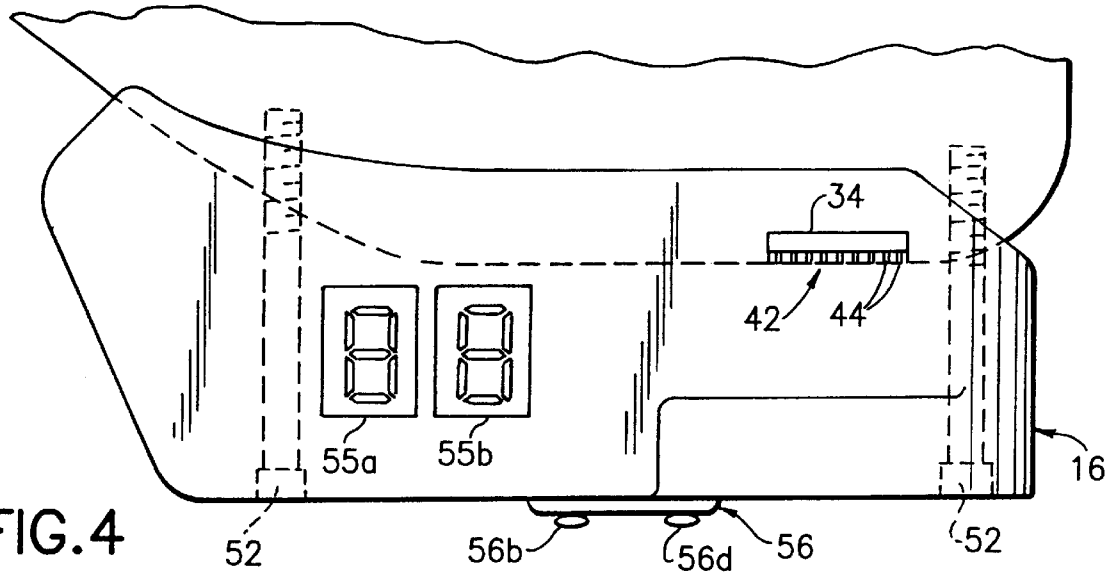
FIG. 4 is an enlarged side elevation view of the data module depicted in FIG. 1 and the lower portion of the gun depicted in FIG. 1 attached thereto.

The gun 12 also has a connector 34 (FIGS. 3, 4 and 7) for electrically coupling the gun to the data module 16. Connector 34 is implemented as a female connector which mates with a male connector 42 on the data module 16. Connector 34 has spaced spring loaded contacts which receive therebetween a PC board 43 and make contact with conductive traces 44 on the PC board 43. Such connectors are well known in the art. In the preferred embodiment, the connectors 34 and 42 have 10 sets of contacts for making the connections shown in FIG. 7. The connector 34 on the gun 12 also activates an eight pole switch 50*a–h* represented schematically in FIG. 7. Seating of male connector 42 of the data module 16 in the female conductor 34 in the gun activates the switches 50*a–h*. The data module 16 is detachably attached to the gun 12 by screws 52 passing through holes in the data module and threadedly received in the bottom of gun 12. The screws 52 may conveniently be tightened and loosened by a coin to allow for easy attachment and detachment of the data module 16 to the gun 12.

Figure 5:
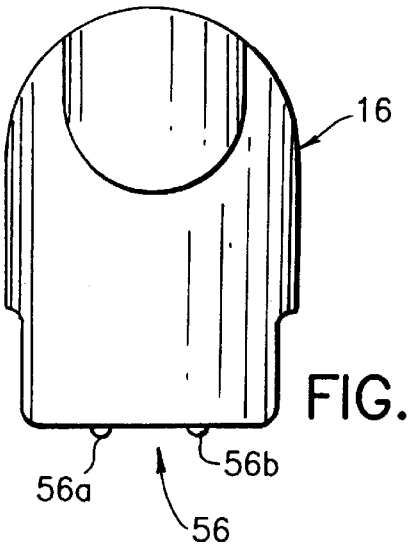
FIGS. 5 and 6 are front elevation and top plan views of the data module depicted in FIG. 1.
Figure 6:
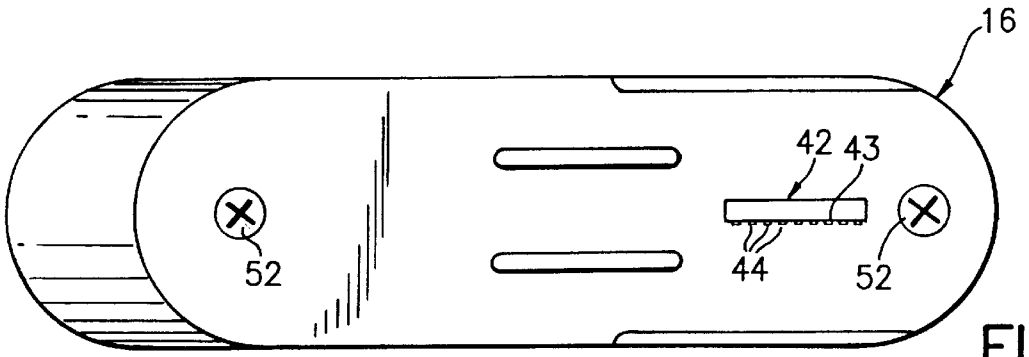
Figure 8:
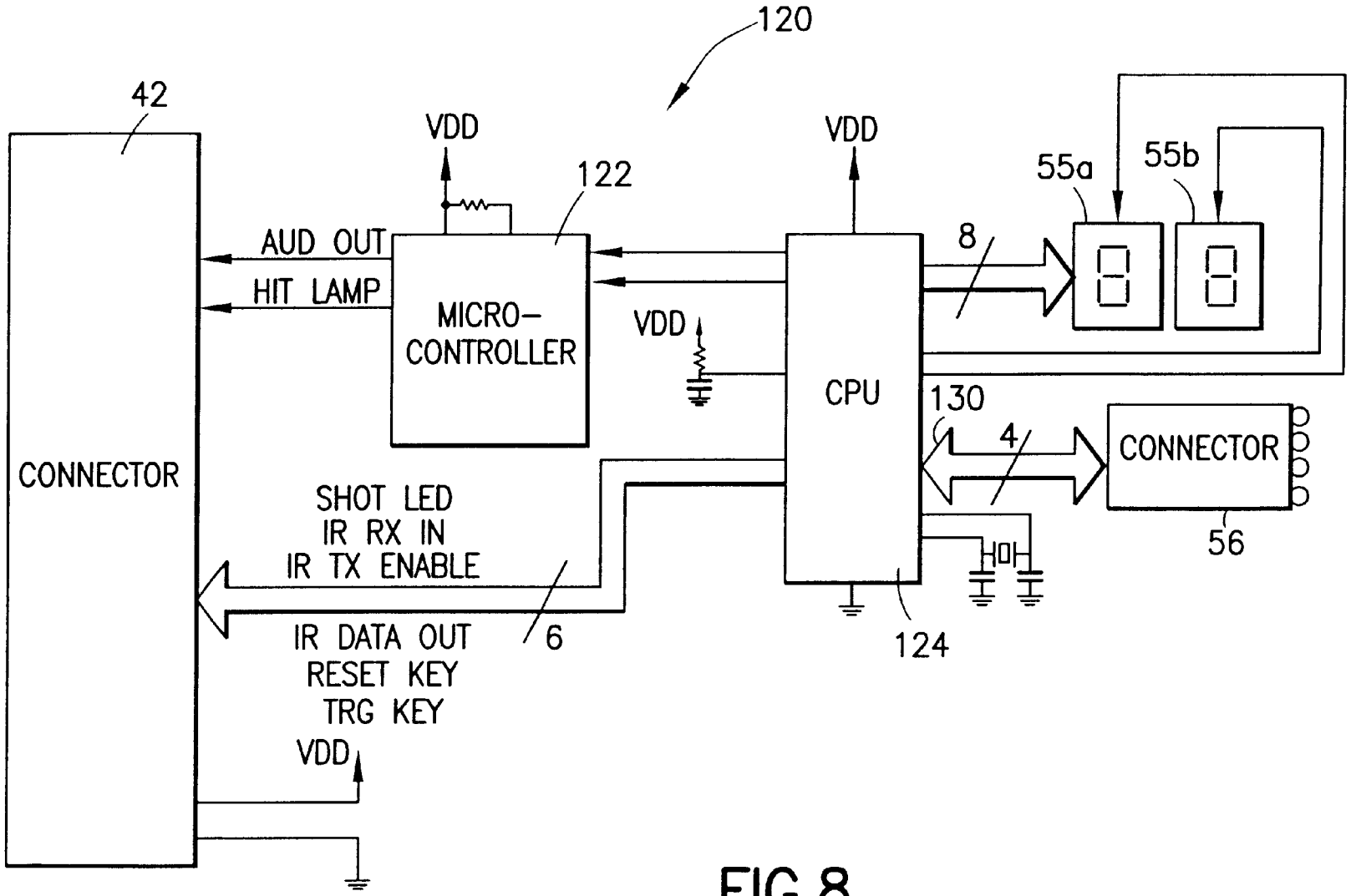
FIG. 8 is a schematic diagram of the circuitry in the data module.

The data module 16 (FIGS. 4–6) includes the connector 42, a display 55*a*, 55*b*, the circuitry shown in FIG. 8, and a connector 56 having four contacts 56*a*–56*d* which couples the data module to the base unit 10. The circuitry in the gun 12, the target 14 is described in more detail below.

The base unit 10 (FIGS. 1, 2 and 8) is battery powered and includes two connectors 57 each having contacts 57*a*–57*d* positioned in a recess 60 which mate with respective data module connectors 56 when respective data modules 16 are seated in respective recesses 60 to couple respective data modules and the base unit 10. The base unit 10 also includes a display 64 (e.g., a liquid crystal device (LCD)), a keypad 70 comprising six keys 71–76 for feature and function selection and data input, and a cursor control 82 comprising four cursor direction or scroll keys 84–87. Exemplary functions may be assigned to the keys 71–76 for selecting menus, assigning teams, selecting data for display and printing, etc. In a preferred embodiment, keys 71–76, respectively, are assigned the following functions: escape to previous screen (ESC); print displayed or indicated data or information (PRINT); game, team feature, function selection and mode menu (MODE); select (ENTER); download to data module (DWNLOAD); and reload (RELOAD). A hinged cover 88 (FIG. 1) is provide to close the top of the base unit 10 in which the display 64, the keypad 70 and the cursor control 82 are positioned. circuitry within the base unit 10 and its connectors are represented in block form in FIG. 9. Further details and operation of the base unit 10 are described below.

Game Play, Functions And Features

The base unit 10, the gun 12, the target 14 and the data module 16 cooperate to provide a toy and shooting games using the toy with the following features and functions:

| | |
|---|---|
| game selection: | opposing teams (red team/blue team); hunted; return to base; every man for himself; restrictions (e.g., limited reload); etc. |
| team selection: | 2 teams (red & blue), 1 to 7 players each (8 players total) |
| download from base to data module (gun): | load data module with game parameters and gun ID (which also indicates team selection) |
| reload gun(s): | reload preprogrammed number of shots into data module at base unit |
| upload from data module (gun) to base: | upload from data module to base shots fired, hits registered with source ID, number of reloads |
| display data: | display team data and player data including predetermined computations |
| print data: | print displayed data |

game selection: opposing teams (red team/blue team); hunted; return to base; every man for himself; restrictions (e.g., limited reload); etc.

team selection: 2 teams (red & blue), 1 to 7 players each (8 players total)

download from load data module with game base to data parameters and gun ID (which also 15 module (gun): indicates team selection) * reload gun(s): reload preprogrammed number of shots into data module at base unit 20 * upload from upload from data module to base data module (gun) shots fired, hits registered to base: with source ID, number of reloads * display data: display team data and player data 25 including predetermined computations * print data: print displayed data The base unit 10 and the data module 16 allow each gun 12 used in a particular game to be set to emit IR light with a unique code and each target 14 to detect hits of IR light and to associate each hit with the unique code carried by the detected IR light. As a result, each data module 16 carries information identifying the number of shots fired by the associated gun, the number of hits registered by the associated target, and the source (player identification) of each hit registered. The data module 16 also carries information indicating the number of times the associated gun 12 was reloaded. The data module 16 can also carry other information gathered from controls, switches and sensors other than the trigger 26, and from a timer implemented by circuitry or software within the data module 16, and the IR detector sensor 15 used in the preferred embodiment described herein. For example, the reload switch 27 and the reset switch 31 may be active with the data module 16, and information may be gathered from those switches. The invention allows individual, team and game performance to be tabulated and analyzed, as described below.

Exemplary of the data that may be computed and displayed for each player is the following:

total number of shots fired total number of hits made by a given player on all other players number of hits by a given player on each opposing player total number of hits registered by a given player from all other players number of hits registered by a given player from each other player firing accuracy percentage (total hits/total shots) per player, and per team damage assessment (hits received/hits made percentage) per player, and per team number of reloads per layer and per team elapsed time before any given event (e.g., first hit, elimination, end of game, etc.)

hits made per minute per player and per team hits received per minute per player and per team shots taken per minute per player and per team An exemplary game may be set and played as follows. First, the group of players decides what game it wants to play. Assuming that the red team/blue team game is selected, the group of players is divided into the two teams. Assume that there are eight players and that four are assigned to the red team and four to the blue team. (Block letters indicate key designations and exemplary displays.)

seat two red team guns/with data modules into the base unit and press the MODE key 73 using the cursor positioning keys 84–87 and the ENTER key 74, select the GAME MENU, then the desired game (RED TEAM/BLUE TEAM)

using the ESC key 71, the cursor control keys 84–87 and the ENTER key 74, select SHOT menu and then the number of shots and reloads press the DWNLOAD key 75 to program the two data modules 16 seated in the base unit 10.

when the download is complete, the display 64 will display DOWNLOAD COMPLETE—READY FOR MORE PLAYERS, and the data modules may be removed repeat the above steps for the data modules of other players, seating two data modules at a time from the same team (or any one last remaining data module alone)

The player sets 18 are now ready for use in the selected game, and play may start 16. The players fire at opposing players while the data module records shots, hits, time, etc., as described above. When a player runs out of shots, he or she must return to the base unit 10, seat the data module 16 (with attached gun) 12 in one of the receptacles and press the RELOAD key 76, all the while being at risk of being hit. A reload may take, for example, two seconds to complete. The game proceeds until a team has won, as determined by hits, players eliminated, or elapse of a predetermined time, etc., which the base unit 10 has programmed into the data modules 16.

At the end of the game, the data modules 16 with the associated guns are seated (two at a time where possible) in the receptacles 60, and the ENTER key 74 pressed. The data in the respective data modules 16 is then uploaded into the base unit 10. Performance statistics may then be selected for viewing, and printing, as indicated above. Particular statistics are selected for viewing by first pressing the MODE key 73, and then progressing through menus and selections using the cursor control keys 84–87 and the ENTER key 74 until the desired statistic is displayed. The display 64 is relatively small and therefore may not display a full screen, e.g., a set of associated statistics. Scrolling (using cursor control keys 84–87) allows the entire screen to be viewed. A larger display may be provided that allows an entire screen to be viewed at the same time. Different sets of statistics may be viewed by use of the MODE key 73, etc. A printer 90 (FIG. 9) is coupled to the base unit 10. Pressing the PRINT key 72 causes the active screen to be printed.

Since the base unit 10 is a computer and since the data module 16 can be programmed, many different features and functions can be programmed into the data module 16, for example, the features and functions described in application Ser. No. 09/015,863. The base unit 10 includes a speaker 92 which sounds appropriate sound effects during programming of the data modules, reloading, uploading and display. The base unit 10 may also include lights which are illuminated as player sets are programmed and data uploaded therefrom, etc.

The particular sequences described above for data entry into the base unit 10 are not critical. The entire sequence may be menu-driven and a single control provided for selection (similar to mouse click entry on personal computers). Also, many different prompts and messages may be appear during the sequences, and pressing an appropriate key continues the process. For example, when programming of a player set has been completed, the display 64 may display the message DOWNLOAD COMPLETE—READY FOR MORE PLAYERS, and when all player sets have been programmed, the display may display the message REMOVE LASERS—DATA READY, START GAME. After a game has been completed and information uploaded from all players etc, the display may display the message START NEW GAME. Also certain events may occur simply by inserting or removing a player set from the base unit, and no key need be pressed to continue or complete a sequence.

In the preferred embodiment, the data modules 16 do not include batteries, and receive power from an associated gun 12. Therefore, the data module 16 must not be detached from its associated gun 12 during play. Data that has not been uploaded from the data module to the base unit 10, when a data module 16 is detached from a gun 12, or the gun's on/off switch 32 is switched off, will be lost.

Electronics

The electronic circuitry of the player set 18 is shown in FIGS. 7 and 8. FIG. 7 shows the circuit 100 in the gun and the circuit 102 in the target 14. In the preferred embodiment, as shown in FIG. 7, control and processing circuit for the target 14 is included in the circuit 100 located in the gun 12, which also supplies power (from batteries 104) to the target 14. The target 14 is tethered to the gun 12 by a four conductor cable 38, which includes conductors for battery voltage (VDD), ground, the output RX DETECT of an IR sensor or receiver 15 and the input (HIT LAMP) to a lamp 104.

The gun circuit 100 includes a microcontroller 106 which receives and processes the output of the IR sensor 15, and controls the speaker 36 and the drive to the lamp 105 in the target 14 whenever a hit is registered. The gun circuit 100 includes another microcontroller 110 which is coupled to the switches 27, 29 and 31 for the trigger 26, the reset button 28 and the reload button 30, respectively. The microcontroller 110 also provides signals to the drive for the shot LED 24 and to an IR transmission circuit 112 (which may be the same as disclosed in application Ser. No. 08/795,895) for the IR LED 22. Microcontrollers 106 and 110 each include a speech synthesizer, and are capable providing signals to the drive for the speaker 36 for realistic sound effects and speech.

The following circuit lines in the circuit 100 (FIG. 7) located in gun 12 are connected to the 10 pin connector 34: HIT LAMP, IR RX IN, RESET KEY, TRG KEY, IR TX ENABLE, IR DATA OUT, SHOT LED, and AUD OUT. The battery voltage VDD and ground are also connected to the connector 34. For each circuit line in circuit 100 connected to the connector 34 (except VDD and ground), a switch

50*a*–50*h* is provided to disconnect the respective point from the associated component in circuit 100. Switches 50*a*–50*h* are closed when the data module 16 is not coupled to the gun 12, and are opened automatically when the data module 16 is coupled to the gun 12. The RELOAD switch 31 remains connected when the data module is coupled to the gun 12, but has no effect since the outputs of the microcontroller 110 are disconnected by switches, 50*c*, 50*f*, 50*g* and 50*h*. When the data module 16 is not coupled to the gun 12, the microcontrollers 106 and 110 process and control respective functions described above with respect to processing for hits, illuminating the hit lamp 104, illuminating the shot LED 24 and enabling and supplying coding signals to the IR transmission circuit 112 generally as described in application Ser. No. 08/795,895.

However, when the data module 16 is coupled to the gun 12, such processing and control is assumed by the circuit 120 (FIG. 8) in the data module 12, as described below. The connectors 34 and 42 may be conventional male/female connectors as are currently used for plugging PC boards into expansion slots in personal computers, i.e., connector 34 may be a conventional spring contact female connector and connector 42 may be a conventional PC card connector.

The switches 50*a*–50*h* are opened by the action of inserting connector 42 into connector 34, and may be accomplished mechanically or electrically. When accomplished mechanically, a suitable connector 34 is selected. Suitable mechanical and electrical means to accomplish the switching will be known to those of skill in the art.

The microcontrollers 106 and 110 may be as described in application Ser. No. 08/795,895, e.g., series 528 microcontrollers available from Winbond Electronics Corp. Alternatively, microcontrollers 106 and 110 may be an SN67003 microcontroller available from Sonix Technology Co., Ltd. In the preferred embodiment, microcontroller 106 is a model W5281 and microcontroller 110 is a model SN67003.

Referring to FIG. 8, the circuit 120 in the data module 16 includes a microcontroller 122, which includes a speech synthesizer, and a microcontroller 124 which functions as the central processing unit (CPU) of the data module 16. CPU 124 requires more input/output ports, memory and processing power than microcontroller 122. Microcontroller 122 may be a series 528 from Winbond Electronics Corp., or as in the preferred embodiment, a model SN67003 from Sonix Technology Co., Ltd. CPU 124 may be any suitable microcontroller, and in the preferred embodiment is a 4-bit model KS57C0002 microcontroller available from Samsung Electronics.

The microcontroller 122 supplies the AUD OUT and HIT LAMP outputs to connector 42, and connector 34 couples them to the hit lamp 104 and speaker 36 in the circuit 100, in which the connections to the hit lamp 104 and the speaker 36 from the microcontroller 106 were opened by switches 50*a* and 50*b*. The microcontroller 122 receives inputs from the CPU 124 for controlling the AUD OUT and HIT LAMP outputs.

The CPU receives following inputs and provides the following outputs on its input/output ports to/from connector 42: SHOT LED, IR RX IN, IR TX ENABLE, IR DATA OUT, RESET KEY and TRG KEY. (The RELOAD key is ineffective when the data module 16 is coupled to the gun 12.) Connector 34 couples these inputs and outputs to corresponding points in the circuit 100, in which the connections between the corresponding points and circuit components in circuit 100 were opened by switches 50*c*–50*h*. The CPU also controls the two element LED display 55*a*, 55*b*. The CPU also provides an input/output port 130 to the connector 56 in the bottom of the data module 16 which connects to the mating connector 57 in the receptacle 60 in the base unit 10. The input/output port 130 functions as a communications port between the base unit 10 and the data module 16, through which data is uploaded to and downloaded from the base unit 10. The base unit 10 is a computer which controls up-loading data from and downloading data to the data module 16.

When the data module 16 is coupled to the gun 12, the CPU 124 controls operation of the player set 18, and the CPU 124 is programmed by the base unit 10 to provide signals with a preselected code on the IR DATA OUT line to modulate the IR TX circuit 122 in the gun circuit 100. As described in application Ser. No. 08/895,795, the IR TX circuit may comprise a bi-stable multivibrator circuit which is enabled via the ENABLE line and caused to oscillate at the selected frequency for the time period determined by the IR DATA OUT line. As discussed above, using the pulse or burst length as the data encoding element, up to 28 different codes may be provided as a practical matter. Other modulation schemes (e.g., pulse width modulation) and circuits may be used, as are know in the art. If compatibility with other toys is not necessary, controllers 106 and 110 and switches 50*a*–50*h* in the circuit 100 may be eliminated, and the microcontrollers 122 and 124 and associated components may be permanently coupled to circuit 100.

The CPU 124 in the data module circuit 120 may include timing circuitry and/or software which measures time and permits the time based computations described here. Time for all player sets can be set to start at the same time, as determined by the base unit, or a control may be provided on the player sets which all players can activate at the same time to time synchronize the player sets.

The display 55*a*, 55*b* on the data module may display any desired parameter, for example, shots taken, shots remaining, reloads, time remaining or elapsed, hits, etc.

While the data module 16 has been described as being software programmable by loading therein data, it may include circuitry which is programmable by configuring the circuitry, rather than by loading software and data. For example, the data module 16 may include programmable logic arrays.

One embodiment may include a keypad coupled to the data module (directly or through circuit 100) for entering data and selecting features and functions, as described in application Ser. No. 09/015,863.

Figure 9:
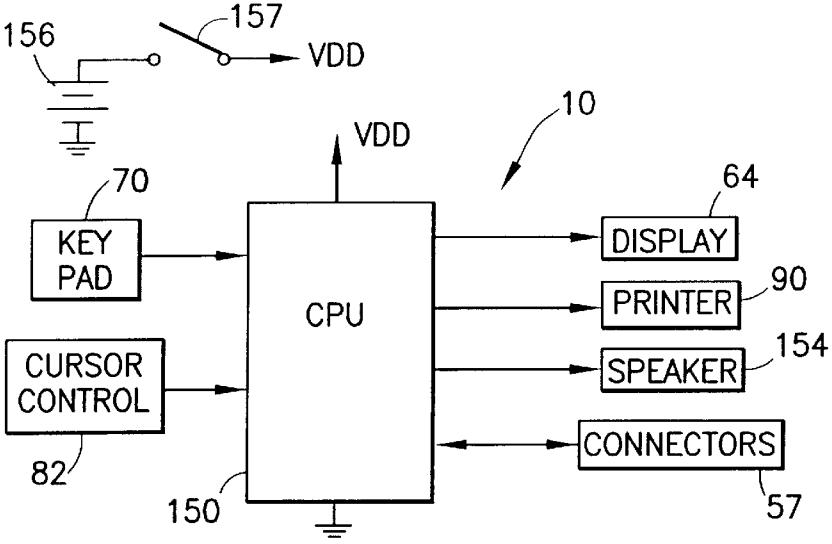
FIG. 9 is an electrical block diagram of the base unit depicted in FIGS. 1 and 2.

Referring to FIG. 9, the base unit 10 includes a microcontroller (CPU) 140 which controls all data entry, display and uploading and downloading functions of associated with the base unit 10. The LCD display 64 is coupled to and controlled by the CPU 140. The keys of the keypad 70 and the cursor control 82 are coupled to appropriate inputs of CPU 140. The printer 90 is coupled to the CPU 150. Connectors 57 couple the communication port of the CPU 150 to data modules 16 via connectors 132. For sounding appropriate sound effects, a speaker 154 is coupled to CPU 140. The base unit 10 is powered by batteries 156. An on-off switch 157 controls application of battery power to the components in the base unit 10.

It is also possible to use a computer such as a personal computer to program the data module 16 and download and upload data and process the data. Those of skill in the art will know how to couple and operate a personal computer to achieve the functions described herein.

Figure 10:
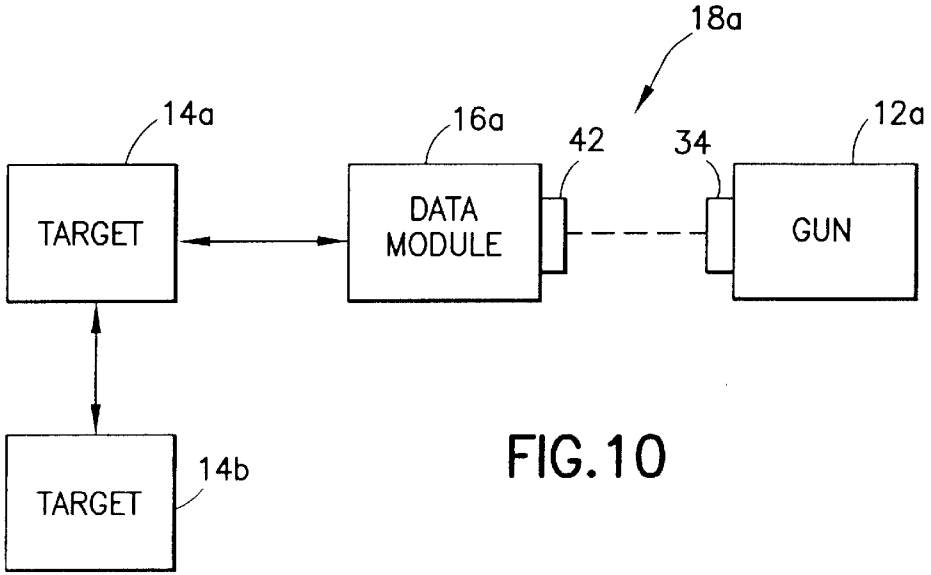
FIG. 10 is a block diagram of an alternate embodiment of a gun, data module and player carried target in which the target is tethered to the data module instead of the gun.

FIG. 10 depicts in block diagram form an alternate embodiment of a play set 18*a* in which the target 14*a* is tethered to the data module 16*a* instead of to the gun 12*a*. In addition, a second target 14*b* is tethered to target 14*a*. Target 14*a* may be as described above, or as described in application Ser. No. 08/895,795 and 09/015,863, and 14*b* may be as described in application Ser. Nos. 08/895,795 and 09/015,863.

The data module 16*a* is detachably attached and electrically coupled to the gun 12*a* as described above for data module 16 and gun 12 using connectors 34 and 42. Coupling of target 14*a* to the data module 16*a* will be apparent to one of skill in the art from the disclosure herein. Connectors 34 and 42 are generally as described above, and gun 12*a* operates with and without data module 16 coupled thereto as described above, except that gun 12*a* does not register or process hits or illuminate the hit lamp in the target 14*a*, but instead operates the same as the gun described in application Ser. No. 08/895,795.

Programming

Programming for the controllers 106, 110, 122, 124 and 140 to carry out the functions described herein can be constructed by one of skill in the art from the disclosure herein without undue experimentation.

While the invention has been described and illustrated in connection with preferred embodiments, many variations and modifications, as will be evident to those skilled in the art, may be made without departing from the spirit and scope of the invention. The invention disclosed herein encompasses additional features and functions supported by the disclosure herein or apparent therefrom, variations of the game modes, features and functions described herein and new modes, features and functions, and variations in combinations and permutations thereof. Controls sensors, switches, the display, lamps and LEDs are located as described and illustrated. However, components may be suitably located, and suitably linked, detachably, wired or wireless, other than as specifically described and illustrated. Also, the toy disclosed herein may incorporate other features and functions, for example those disclosed in application Ser. No. 09/015,863, and may be used in many different games other than those disclosed herein. The invention as set forth in the appended claims is thus not limited to the precise details of construction set forth above as such variations and modifications are intended to be included within the spirit and scope of the invention as defined in the appended claims.

What is claimed is:

1. A toy for a shooting game comprising:

a wave energy projector comprising a wave energy source with projects wave energy from said projector;

at least one circuit coupled to said energy source which controls operation of said energy source and causes said energy source to project wave energy coded according to any one of a plurality of codes in response to an input;

a player programmable device coupled to said at least one circuit to provide coded information thereto;

said at least one circuit being responsive to coded information provided by said programmable device to cause said energy source to project energy with a code of the plurality of codes corresponding to said coded information in response to the input.

2. The toy of claim 1 wherein said toy is operable in a plurality of game modes, said at least one circuit operating said toy in a first game mode in the absence of coded information from said programmable device and in a second game mode in response to coded information from said programmable device.

3. The toy of claim 1 wherein said programmable device and said at least one circuit are detachably coupled, said at least one circuit operating said toy in a first game mode when said programmable device is not coupled to said at least one circuit, and in a second game mode when said programmable device is coupled to said at least one circuit.

4. The toy of claim 3 comprising a switch permanently coupled to said programmable device or said at least one circuit which disconnects at least a portion of said at least one circuit when said programmable device is coupled to said at least one circuit.

5. The toy of claim 1 wherein said programmable device comprises a memory device storing a computer program and data, and circuitry which executes the program stored in said memory device, said programmable device providing the coded information to said at least one circuit in response to the computer program.

6. The toy of claim 5 wherein said programmable device comprises programmable circuitry configured to provide said coded information.

7. The toy of claim 2 comprising a programming device and a transmission link couplable by a player to said programmable device and said programming device cooperating to program said programmable device via said transmission link.

8. A. The toy of claim 7 wherein said transmission link is wired.

9. The toy of claim 8 wherein said programmable device and said programmed device each include connectors by means of which said transmission link is established, at least one of said connectors being releasably coupled in said transmission link.

10. The toy of claim 9 wherein said connectors mate and electrically connect to each other.

11. The toy of claim 7 wherein said programming device comprises an input device coupled thereto having at least one manually actuated control by which information can be input to said programming device, said programming device being responsive to the input information and supplying selected information to said programmable device in dependence upon the input information.

12. The toy of claim 11 wherein said programming device comprises a display which displays information thereon in accordance with the computer program, said programming device relating information input by said input device with information displayed by said display.

13. The toy of claim 12 wherein said programming device causes said display to scroll in response to information input by said input device.

14. The toy of claim 12 wherein said input device comprises a first control in response to which said programming device receives input information and a second control in response to which said programming device causes said display to scroll.

15. The toy of claim 1 wherein said programmable device is coupled to said circuit by a transmission link.

16. The toy of claim 15 wherein said programmable device and said circuit include connectors by means of which said transmission link is established, at least one of said connectors being releasably coupled in said transmission link.

17. The toy of claim 15 wherein said connectors mate and electrically connect to each other.

18. A modular toy for a shooting game comprising:

a wave energy projector comprising a wave energy source which projects wave energy from said projector;

a first circuit permanently coupled to said energy source and which controlling operation of said energy source;

one or more housings in which said first circuit and said wave energy source are mounted;

a circuit module removably coupled in one of said housings to said first circuit, said circuit module when coupled to said first circuit altering operation of said energy source as compared to operation of said energy source by said first circuit when said module is not coupled to said first circuit.

19. A modular toy for a shooting game comprising:

a wave energy sensor which detects wave energy with predetermined characteristics impinging thereon and provides corresponding output signals;

a first circuit permanently coupled to said wave energy sensor to receive said output signals and process said output signals;

one or more housings in which said first circuit and said wave energy sensor are mounted;

a circuit module removably coupled in one of said housings to said first circuit, said circuit module when coupled to said first circuit altering processing of said output signals as compared to processing by said first circuit when said module is not coupled to said first circuit.

20. The combination of a portable toy for use in a toy shooting game and a computer, said toy comprising at least one wave energy source, and a programmable circuit for operating said wave energy source, said toy and said computer having a communication link therebetween, said toy being capable of wireless operation with respect to said computer, said toy and said computer cooperating via said communication link to program said circuit from said computer, said programmable circuit being detachably electrically and mechanically coupled to said energy source, said toy comprising another circuit permanently coupled to said energy source to operate said energy source when said programmable circuit is not coupled thereto.

21. The combination of claim 20 comprising a printer coupled to said computer, said computer including a memory device in which said computer stores information relating to operation of said energy source, said computer causing said printer to print stored information relating to the operation of said energy source.

22. The combination of claim 21 comprising a display coupled to and controlled by said computer, said computer including a memory device in which said computer stores information relating to operation of said energy source, said computer causing said display to display stored information relating to the operation of said energy source.

23. The combination of claim 20 wherein said computer and said programmable circuit cooperate to program said programmable circuit to operate said energy source to cause it to emit wave energy with a given code.

24. The combination of claim 20 wherein said computer and said programmable circuit cooperate to program said programmable circuit to operate said energy source to cause it to emit wave energy only a given number of times and thereafter disable energization of said energy source.

25. The combination of claim 24 wherein said computer and said programmable circuit cooperate to program said programmable circuit in response to a given condition to again operate said energy source to cause it to emit wave energy for only a given number of times again, and thereafter again disable energization of said energy source.

26. The combination of claim 25 wherein said condition is reprogramming of said programmable circuit by said computer.

27. A toy for a shooting game having a plurality of player sets, each comprising:

a wave energy projector comprising a wave energy source which projects wave energy from said projector in response to an input signal;

a wave energy sensor providing signals responsive to wave energy received by said sensor emitted by another energy projector having another energy source compatible with said energy source;

a transmission circuit which energizes said energy source;

a programmable controller which causes said transmission circuit to energize said energy source according to a given code which is different for each player set or teams of player sets, processes said signals provided by said energy sensor, makes a determination that a hit has occurred when energy received by said energy sensor has been emitted by an energy source of another player set of said plurality of player sets and detects the code of the energy received from another player set; and a programmable device removably couplable to a player set for programming the programmable controller thereof to cause said transmission circuit to energize said energy source according to a given code.

28. The toy of claim 27 comprising a programmed device removably coupled to a player set for receiving information from said controller relating to energization of said energy source and signals received from said energy sensor.

29. The toy of claim 28 wherein said programmed device process said information and provides statistics on at least one of the following: the number of energizations of said energy source, and the number of hits determined;

another energy projector, said at least one circuit including a transmission being programmable to cause;

an input device coupled to said at least one circuit;

said at least one circuit being responsive to coded information provided by said input device to cause said toy to change its status or operation.

* * * * *